US005312021A

United States Patent [19]

Nelson

[11] Patent Number: 5,312,021

[45] Date of Patent: May 17, 1994

[54] MOTORIZED TOILET TISSUE DISPENSER

[76] Inventor: Eric C. Nelson, Rte. 1, Box 50, Gates, N.C. 27937

[21] Appl. No.: 121,192

[22] Filed: Sep. 15, 1993

[51] Int. Cl.[5] ..... B67D 5/06; B65H 16/00

[52] U.S. Cl. ..... 222/183; 221/96; 222/192; 239/289; 242/55.2

[58] Field of Search ..... 222/130, 180, 181, 183, 222/192, 321; 242/55.2, 55.3, 55.53; 221/96; 239/289

[56] References Cited

U.S. PATENT DOCUMENTS

| | | | |
|---|---|---|---|
| 1,674,285 | 6/1928 | Harvey | 242/55.2 |
| 2,411,310 | 11/1946 | Wilkins | 222/183 X |
| 2,746,798 | 5/1956 | Wardell, Jr. | 239/289 X |
| 2,964,543 | 10/1990 | Scheiber | 222/180 |
| 3,008,659 | 11/1961 | Plotkin et al. | 242/55.2 |
| 3,210,139 | 10/1965 | Ciervo | 242/55.3 UX |
| 3,317,150 | 5/1967 | Summersby | 242/55.2 |
| 3,776,773 | 12/1973 | Taft | 239/283 X |
| 3,865,271 | 2/1975 | Gold | 221/96 |
| 3,980,203 | 9/1976 | Dearling | 221/96 |
| 4,071,200 | 1/1978 | Stone | 242/55.2 |
| 4,721,265 | 1/1988 | Hawkins | 242/55.53 |
| 4,783,016 | 11/1988 | Pool | 242/55.2 |
| 4,844,368 | 7/1989 | Hu | 242/55.53 |
| 4,991,538 | 2/1991 | Davids et al. | 221/96 X |

FOREIGN PATENT DOCUMENTS

| | | | |
|---|---|---|---|
| 2653983 | 5/1991 | France | 221/96 |
| 2045722 | 11/1980 | United Kingdom | 242/55.2 |
| WO9219141 | 11/1992 | World Int. Prop. O. | 221/96 |

*Primary Examiner*—Kevin P. Shaver
*Attorney, Agent, or Firm*—Richard C. Litman

[57] ABSTRACT

The present invention provides a dispenser for both rolled paper products and liquid fluid having scent therein. The dispenser allows an individual that is injured, handicapped, or otherwise unable to grasp and unroll the rolled product, to have the product unrolled automatically by depressing a single button. In addition, a fluid dispenser is incorporated within the rolled paper product dispenser so that the individual using the present invention may be provided with a convenient apparatus for freshening the air adjacent the dispenser when desired.

4 Claims, 5 Drawing Sheets

MOTORIZED TOILET TISSUE DISPENSER

BACKGROUND OF THE INVENTION

1. Field of the Invention

The present invention relates to toilet tissue holders, and more specifically, motorized toilet tissue dispensers.

2. Description of the Prior Art

The have been patented devices in the past that not only rotatably support a roll of paper product, such as toilet paper, but that are also capable of automatically dispensing a desired length of the product to a user. U.S. Pat. No. 1,674,285, issued on Jun. 19, 1928 to Leaman S. Harvey, discloses a holder for paper rolls, specifically toilet paper rolls. Harvey's holder comprises a bracket member for attachment to a planar supporting surface such that a portion of the bracket extends normal to the supporting surface. The bracket has means for accepting a plurality of clamps or biased spools that rotate with and without ball bearing against the bracket, for removably engaging the inner portion of a cylinder about which the paper product is wound so that the same may be unrolled as needed.

U.S. Pat. No. 3,008,059, issued on Nov. 14, 1961 to Frederic P. Plotkin et al., discloses a dispensing device for rolled material comprising a base frame structure having two roll supporting arms extending therefrom. One of Plotkin's rolls supporting arms is pivotally attached to the base frame structure and biased so as to better retain a roll of paper product between the two roll supporting arms.

Examples of electronic toilet tissue dispensers within the patent record are U.S. Pat. No. 4,071,200, issued on Jan. 31, 1978 to Barry N. Stone and U.S. Pat. No. 4,721,265, issued on Jan. 26, 1988 to Junior F. Hawkins. Stone's dispenser is seen as a battery powered, switch activated, dispenser having a rectangular frame with two mounting arms attached thereto. A cylinder is provided to engage the roll of paper product to be dispensed. A biased peg extends from within the cylinder to retain the cylinder between the two mounting arms. Furthermore, gear means are utilized to rotate the cylinder once placed between the mounting arms. The Hawkins dispenser is also seen as a battery powered toilet tissue dispenser that is activated through a sensor-type switch as opposed to a manual-type switch. The motor of Hawkins' dispenser transfers power to the toilet paper roll by means of a belt and pulley-type arrangement. A spring-biased handle arrangement provides proper compressive forces to secure the toilet paper roll within the dispenser.

U.S. Pat. No. 4,783,016, issued on Nov. 8, 1988 to Daniel L. Pool, is presented herein to further illustrate means for retaining a roll about a central rotating member. Through the utilization of a shaped wire member, Pool's roll holder engages the inner surface of a roll with enough frictional for that the roll will not slip as the holder is rotated.

None of the above inventions and patents, taken either singly or in combination, is seen to describe the instant invention as claimed.

SUMMARY OF THE INVENTION

The present invention recognizes the need of older, arthritic, and handicapped individuals to have a rolled paper product automatically dispensed, unrolled, for use. Specifically, when in the bathroom, this need is constantly encountered when toilet paper is required by both men and women.

Accordingly, it is a principal object of the invention to provides a means for automatically dispensing rolled paper products through the incorporation of a battery powered, manual switch activated dispenser in the bathroom.

It is another object of the invention to provide such a dispensing apparatus having a construction that is easily accessible, practical, and not prone to breakdown; this is accomplished by housing all of the operable components within one small contained area of the dispenser so that no excessive wiring or structure is required for the dispenser to operate. In moist and humid environments, such as that found in bathrooms, the more components and length of wire one has exposed, the greater the chances of being adversely affected by the ambient moisture. The present invention has overcome this by concentrating all the components of the invention into one section of the dispenser.

It is a further object of the invention to have the capability of further providing dispensing means for a liquid type airfreshening scent that may be housed within the dispenser itself in such a manner that is easy to access for dispensing as well as refilling purposes.

Still another object of the invention is to provide an electronic motorized rolled paper product dispenser that itself is easily accessed so that rolls of paper product may be easily changed into and out the dispenser by means of a spring-biased supporting arm at one end of the dispenser capable of both supporting the paper product roll itself as well as securing a roll holder against a gearing assembly that rotates the paper roll when in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a means for automatically dispensing rolled paper products, such as toilet paper, in an automated, but easily controlled, manner.

Figure 1:
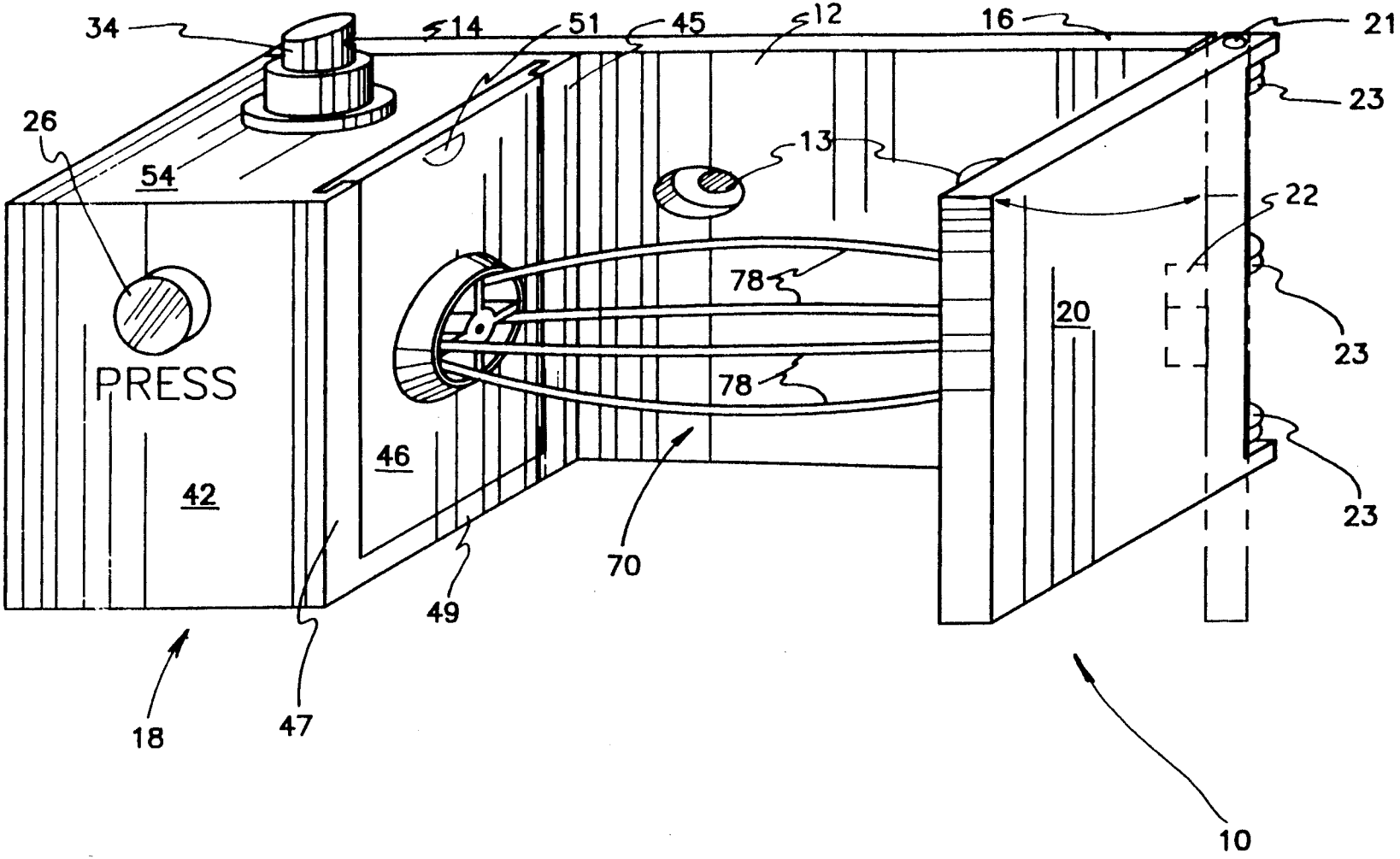
FIG. 1 is a perspective view of the motorized toilet tissue dispenser with pivotal side wall support arm shown in a closed as well as open position, as shown in phantom lines.
Figure 2:
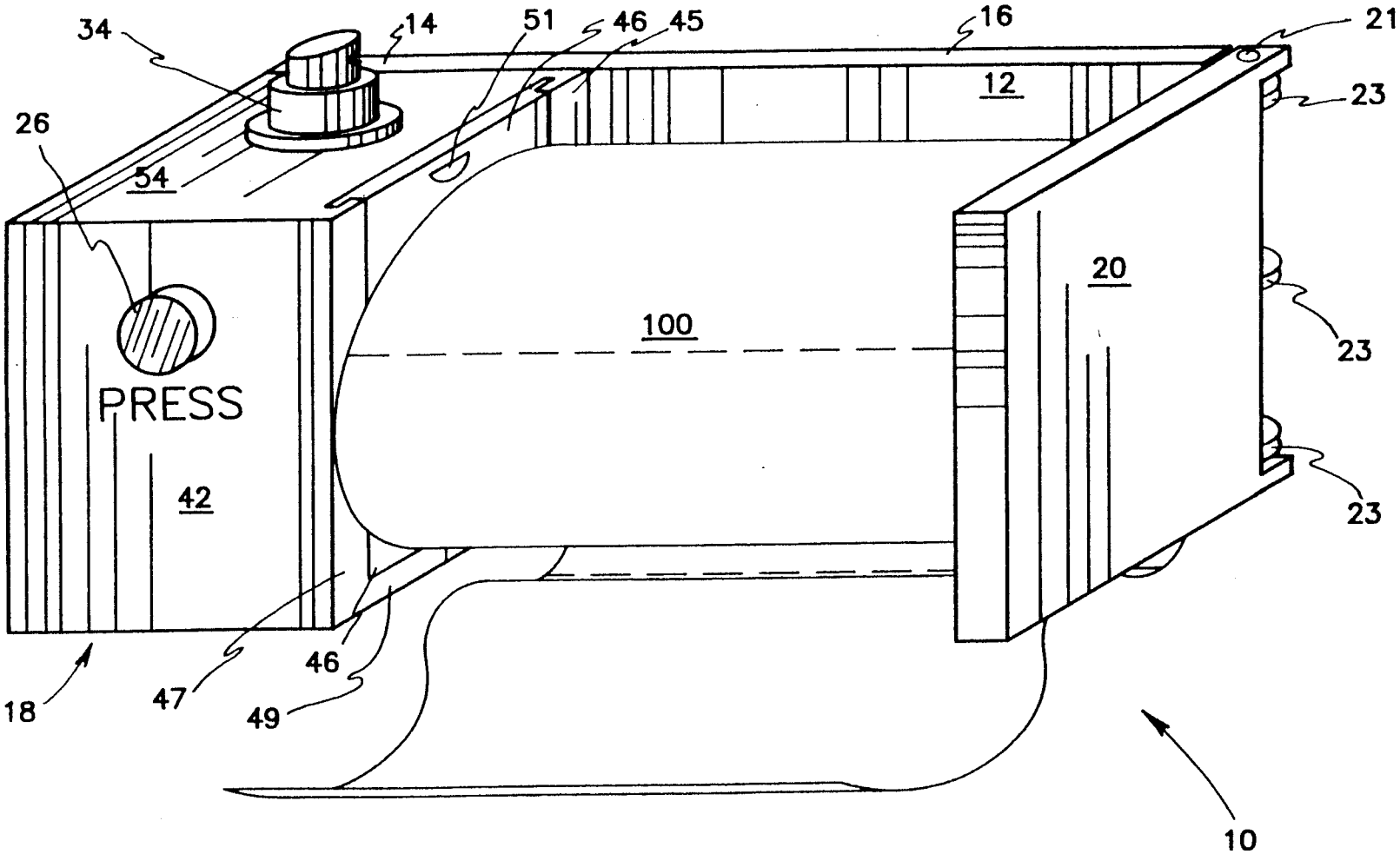
FIG. 2 is an environmental perspective of the motorized toilet tissue dispenser with toilet tissue roll in place upon the roll support member.
Figure 3:
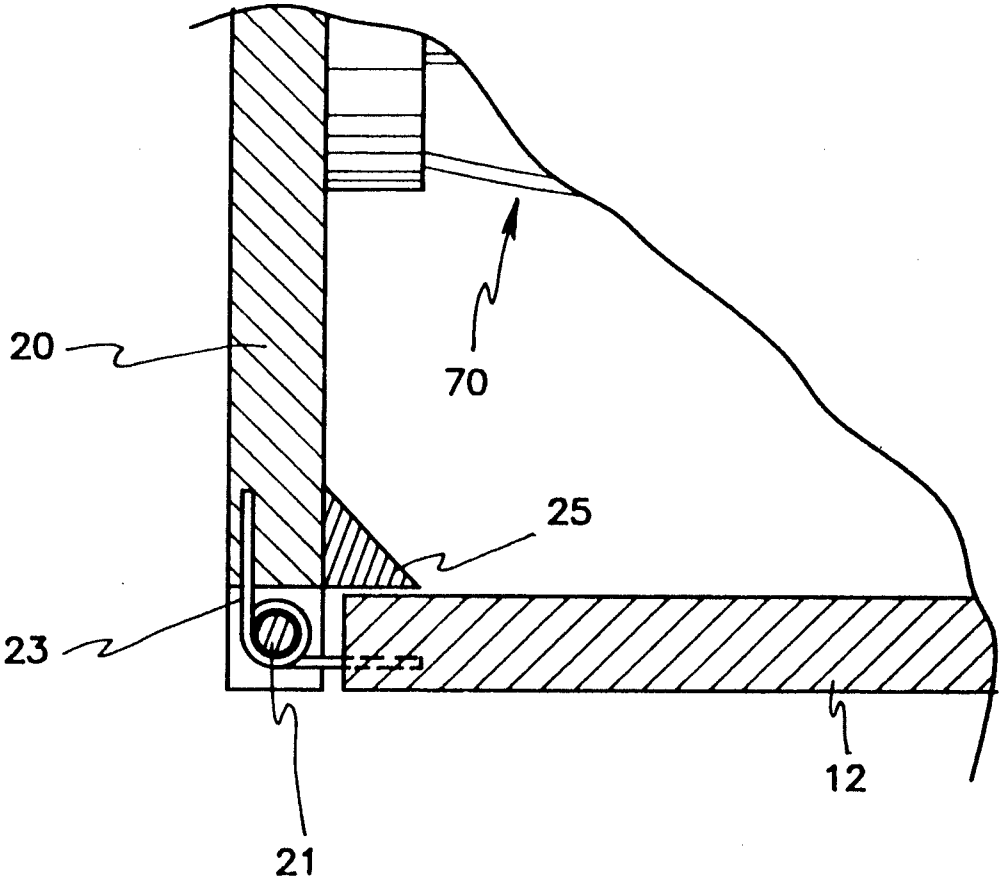
FIG. 3 is a cut-away detail of FIG. 1 showing the biasing means used to hold the side wall in its closed position.

A rolled paper product and fluid dispenser 10 for dispensing rolled toilet paper and liquid bathroom scent is shown in FIGS. 1 and 2. A mounting plate 12 may be removably attached to a supporting vertical wall structure (not shown) by typical screw-type fasteners (not shown) secured through cylindrical bores 13, 13 of mounting plate 12. Mounting plate 12 has a rectangular shape and a first end and a second end, opposite one another. First end 14 of mounting plate 12 has housing 18 for securing the components of the electric motor drive means 24 therewithin. Second end 16 of mounting plate 12 has a pivotal side wall 20 attached thereto by a pair of pin fasteners 21, 21. Supported within side wall 20 is idler spindle 22 that supports an end of roll support member 70. Coil spring members 23, 23, 23 bias side wall 20 to a closed position (see also FIG. 3). However, to ensure that the biasing of side wall 20 does not close upon roll support member 70 with too great a force, triangular stop member 25 has been incorporated onto second end 16 of mounting plate 12.

Figure 4:
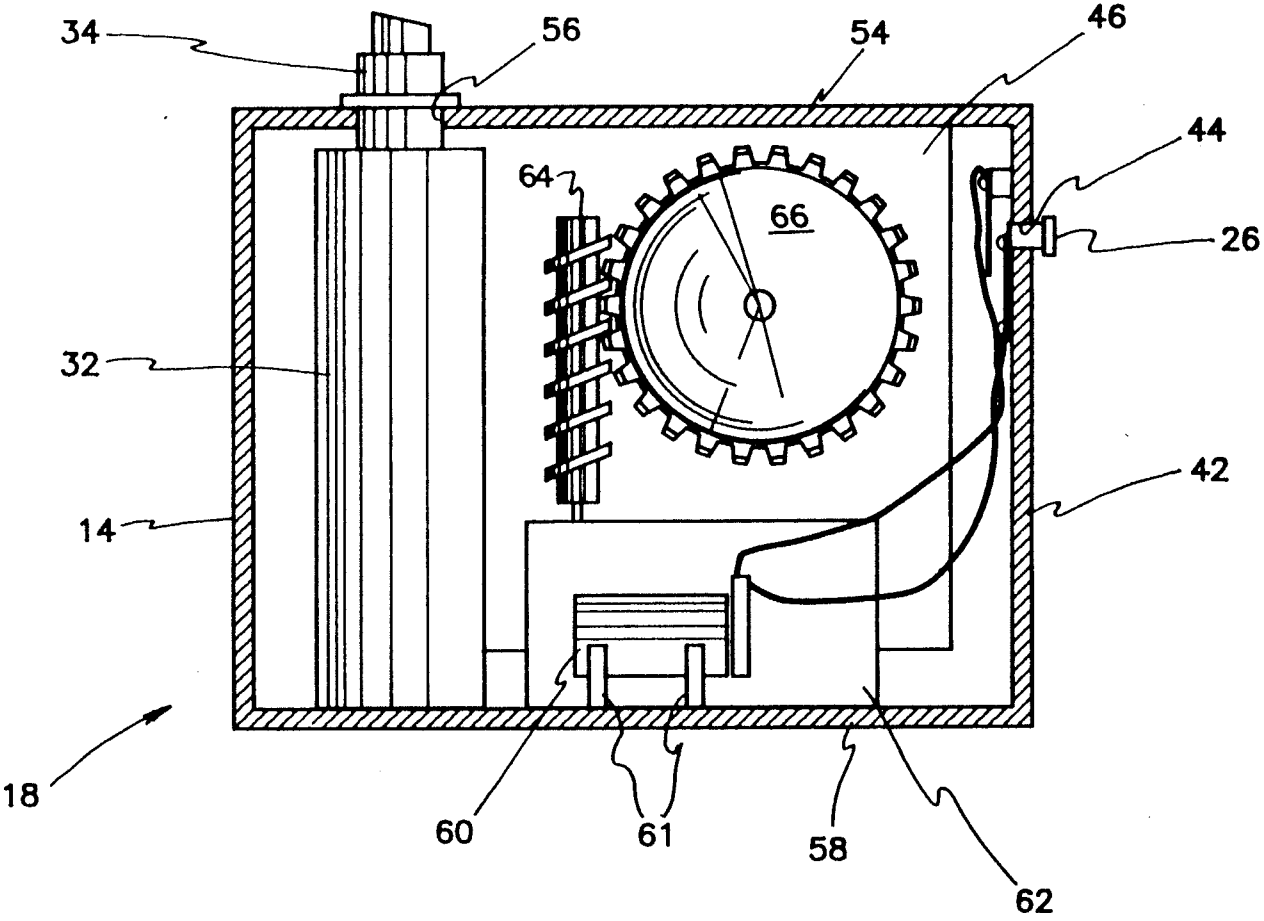
FIG. 4 is a sectional view of the housing showing the components therewithin.

Housing 18, illustrated in FIGS. 1, 2 and 4, is seen as being integrally formed, and includes first end 14 of mounting plate 12, such that first end 14 is a first wall of housing 18. A second wall 42 is positioned directly across from the first end 14 (first wall) and is parallel thereto. First end 14 (first wall) and second wall 42 are connected by top wall 54 and bottom wall 58. Fourth wall 50 is connected to top wall 54, bottom wall 58, first end 14 (first wall), and second wall 42. Lastly, third wall 46 is seen as a removable wall that engages slots 45, 47, and 49 that extend from first end 14 (first wall), second wall 42, and bottom wall 58, respectively. A small depression 51 on the surface of third wall 46 allows wall 46 to be removed from slots 45, 47, and 49 so that the inside of housing 18 may be easily accessed at any time for maintenance and repairs. In addition, third wall 46 is seen as having a circular opening 48 therein so as to support roll support assembly 70 as it enters housing and engages worm gear 64. In a similar fashion, second wall 42 and top wall 54 are seen as having cylindrical bores 44 and 56, respectively. Cylindrical bore 44 within second wall 42 allows actuating means 26, a mechanical switch, that controls the operation of the motor to extend therethrough, while cylindrical bore 56 is top wall 54 allows pump means 34, that dispenses fluids from fluid receptacle 32, to extend therethrough. Contained within housing 18 are electric motor drive means 24 and fluid receptacle 32 which may be clearly seen in FIG. 4. Electric motor drive means 24 comprises: battery 60, supported upon battery stand 61; DC electric motor 62; actuator means 26, the mechanical switch; and vertically displaced worm gear 64.

Figure 5:
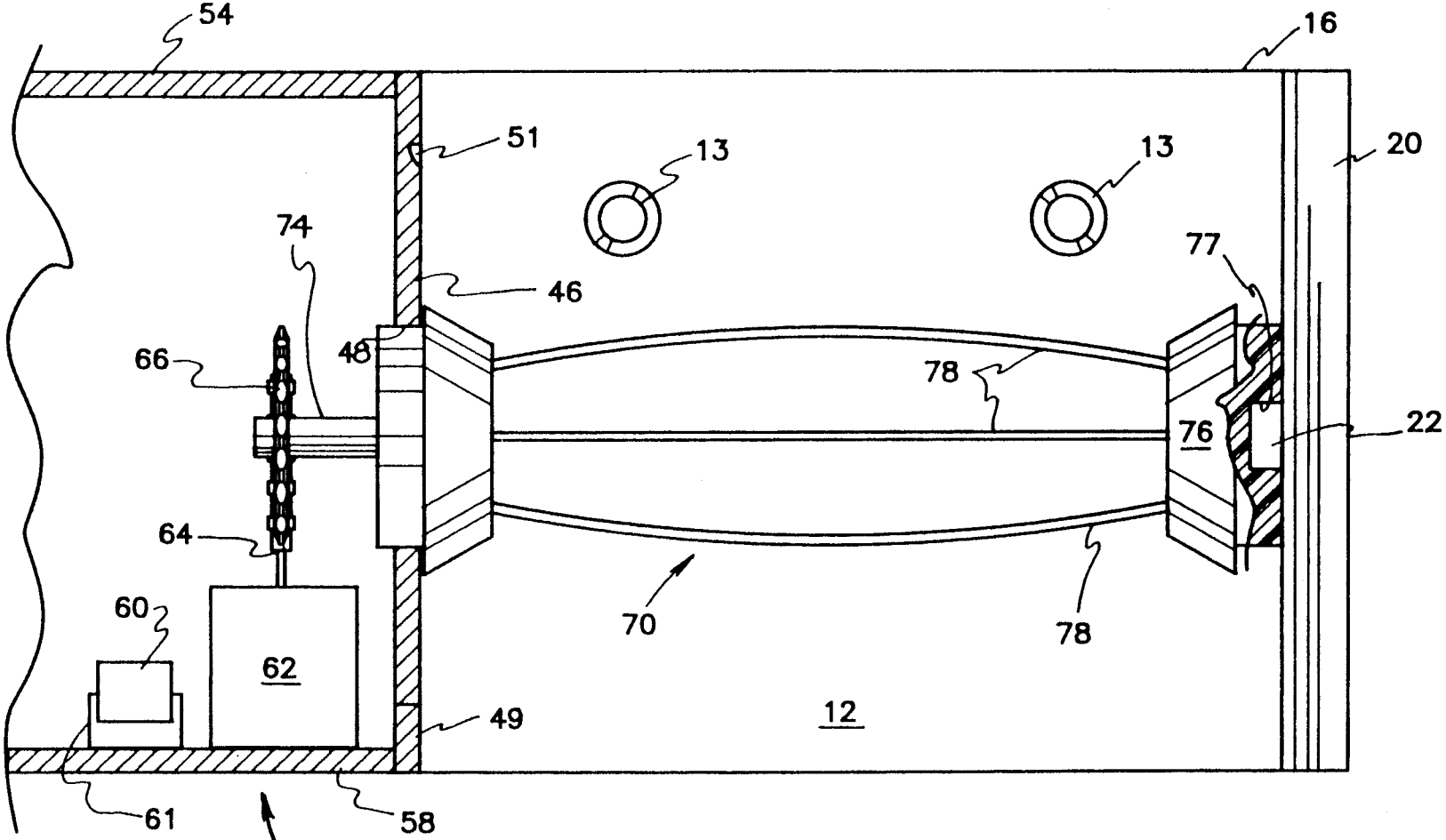
FIG. 5 is a detail view, partly in section, showing the roll support member as it engages the housing, the drive spindle assembly and the idler spindle.

Supporting toilet paper roll 100 is roll support assembly 70 as shown in FIG. 2. Roll support assembly, as illustrated in FIG. 5, comprises four arcuate, slightly flexible, rods 78..78 connected to and held between two end support cups 72 and 76. The slight flex of arcuate rods 78..78 allow roll support assembly 70 to retain paper roll 100 thereon without slipping during rotation of the same. Specifically, end support cup 72 has a flanged, cylindrical construction with a rod 74 extending axially from the cross-sectional center thereof in one direction and arcuate rods 78..78 extending in the other direction. A transfer gear 66, axially engages the free end of rod 74 so as to transmit rotational power from electric motor 62 and worm gear 64 to roll support assembly 70. The flanged, cylindrical construction of end support cup 72 ensures proper alignment of transfer gear 66 with worm gear 64, so that the rotational motion of worm gear 64 drives transfer gear 66 and roll support assembly 70. The ends of arcuate members 78..78 not attached to end support cup 72 are attached to one side of end support cap 76. The other side of end support cap 76 is seen as having a counter sunk, cubical cut-out 77 that accepts the block end of idler spindle 22.

Hence, when side wall 20 is held in an open position, roll support assembly 70 may be removed therefrom for purposes of accessing the interior of housing 18 or resupplying a new roll of toilet tissue 100. When side wall 20 is released, biasing springs 23..23 close side wall 20 so that roll support assembly 70 is rotatably supported on idler spindle 22 and cylindrical opening 48 of third wall 46. To prevent frictional binding between flanged cylindrical member 72 of roll support member 70 and the surface of third wall 46 adjacent cylindrical opening 48, previously mentioned triangular stop member 25, attached to mounting plate 12, provides positive stop means for biased side wall 20.

To use rolled paper product and fluid dispenser 10, an individual need only depress actuator means 26 to begin unrolling the toilet paper 100. When the desired length has been dispensed, releasing actuator means 26 will stop roll support assembly 70 from unrolling toilet paper 100. Should freshening of the room containing rolled paper product and fluid dispenser 10 need freshening at any time, pump means 34 may be utilized to dispense liquid scent from fluid receptacle 32 positioned within housing 18.

It is to be understood that the present invention is not limited to the sole embodiment described above, but encompasses any and all embodiments within the scope of the following claims.

I claim:

1. A rolled paper product and fluid dispenser comprising:

a mounting plate having opposite first and second ends, a housing affixed to said mounting plate first end, a side wall pivotally attached to and biased against said mounting plate second end, and an idler spindle carried by said side wall;

electric motor drive means within said housing, actuating means controlling operation of said motor drive means, a transfer gear connected to said motor drive means whereby, upon manipulation of said actuating means, a roll of paper products mounted between said idler spindle and said drive spindle is unwound to deliver for use a section of said paper product;

said housing including a receptacle adapted to contain fluid, and pump means communicating with said receptacle and operable to dispense selected amounts of fluid as contained within said receptacle.

2. The motorized toilet tissue dispenser according to claim 1, wherein:

said housing comprises a substantially cubical walled structure defined by six walls: a first wall of said six walls being an end, planar, portion of said mounting plate; a second wall of said six walls being opposite the first and having means defining an aperture therein; a third wall of said six walls positioned normal the first and second, removably connecting the two and having means defining a circular opening therein; a fourth wall of said six walls opposite said third wall having a pivotal panel incorporated therein; a fifth wall of said six walls having attached atop the housing connected to said first, second, third, and fourth walls having means defining an opening for receiving said pump means; and a sixth wall of said six walls being a solid bottom plate connected to said first, second, third, and fourth walls.

3. The motorized toilet tissue dispenser according to claim 1, wherein:

said electric motor drive means comprises a battery, an electric motor, and actuating means all in electrical communication with one another, as well as a worm gear extending vertically upward from said electric motor, engaging said transfer gear, said gear being axially connected to a roll support assembly.

4. The motorized toilet tissue dispenser according to claim 3, wherein:

said actuating means comprise a push button manual switch for completing an electric circuit between said battery and said electric motor.

* * * * *